United States Patent [19]

Slocum

[11] 4,431,905

[45] Feb. 14, 1984

[54] CONDENSATE EVAPORATOR

[76] Inventor: Charles W. Slocum, 423 Highway 71, Spring Lake Heights, N.J. 07762

[21] Appl. No.: 277,079

[22] Filed: Jun. 25, 1981

[51] Int. Cl.[3] ..... F22B 1/30; H05B 1/02; H05B 3/60

[52] U.S. Cl. ..... 219/274; 219/284; 219/275; 219/290; 62/150

[58] Field of Search ..... 219/271-276, 219/284, 288, 289, 290, 293; 62/275, 150, 285, 289, 291; 261/142; 239/135, 136; 128/203.17, 203.27

[56] References Cited

U.S. PATENT DOCUMENTS

| | | | |
|---|---|---|---|
| 2,016,368 | 10/1935 | Gaugler | 62/150 |
| 2,152,157 | 3/1939 | Sittler | 219/275 |
| 2,239,038 | 4/1941 | Greenfield | 219/271 |
| 2,429,112 | 10/1947 | Warren | 219/274 |
| 2,474,113 | 6/1949 | Osipow | 219/201 |
| 4,028,526 | 6/1977 | Schossow | 219/295 |
| 4,260,874 | 4/1981 | Will | 219/274 |
| 4,266,116 | 5/1981 | Bauer | 219/274 |

*Primary Examiner*—B. A. Reynolds
*Assistant Examiner*—Teresa J. Walberg
*Attorney, Agent, or Firm*—Roger A. Clapp

[57] ABSTRACT

An improved condensate evaporator is disclosed in which a condensate collecting container supports a salt impregnated pad, a pair of electrodes and a cover assembly. The salt pad is adapted to convert the liquid condensate into an electrolyte on contact, the electrodes are adapted to transmit electrical current through the electrolyte until it evaporates and the cover assembly controls ingress and egress of the liquid and vaporized condensate, respectively, while simultaneously shielding users from electrical hazards.

5 Claims, 2 Drawing Figures

CONDENSATE EVAPORATOR

BACKGROUND OF THE INVENTION

1. Field of the Invention

This invention relates to evaporative devices and pertains in particular to those in which condensate is dispersed by electrically heating the condensate until it vaporizes.

2. Description of the Prior Art

Refrigerating devices generate substantial amounts of condensate during operation. That condensate must be removed, and, typically, the condensate is collected in a container and then heated until it vaporizes. Heretofore, the heating elements have been self contained; that is, they heat by mechanical conduction. Consequently, timing devices, a thermostatic control, or a liquid level sensing device is required to control the operation of the electrical heating elements. When those devices fail, however, serious consequences are experienced including the possibility of fire and other disasterous effects.

Accordingly, one object of this invention is to achieve evaporation of condensate in a safe, efficient and trouble free manner.

In accordance with one important feature of this invention, efficient heating is achieved by interacting the condensate with a salt impregnated blotter-like element to form an electrolyte and then evaporating the electrolyte with heat generated by passing an electrical current through two electrodes and the electrolyte when the electrolyte wets the surfaces of the electrodes.

In accordance with another feature of this invention, safe operation is achieved by disposing an electrically grounded plate between a cover plate and the electrodes and perforating the grounded plate and cover plate with misaligned apertures to prevent mechanical egress into the container.

SUMMARY OF THE INVENTION

In accordance with a preferred embodiment of the invention, a safe, efficient and trouble free evaporator is achieved by combining a salt impregnated pad, two electrodes and a cover assembly with a condensate collecting container wherein the salt impregnated pad is adapted to convert the liquid condensate into an electrolyte on contact, the electrodes are adapted to transmit electrical current through the electrolyte until it evaporates and the cover assembly controls ingress and egress of the liquid and vapor condensate, respectively, while simultaneously shielding users from electrical hazards.

These and other features of the invention will be more readily understood by reference to the detailed specification and drawing.

DETAILED DESCRIPTION OF THE DRAWING

DETAILED DESCRIPTION OF THE INVENTION

Figure 1:
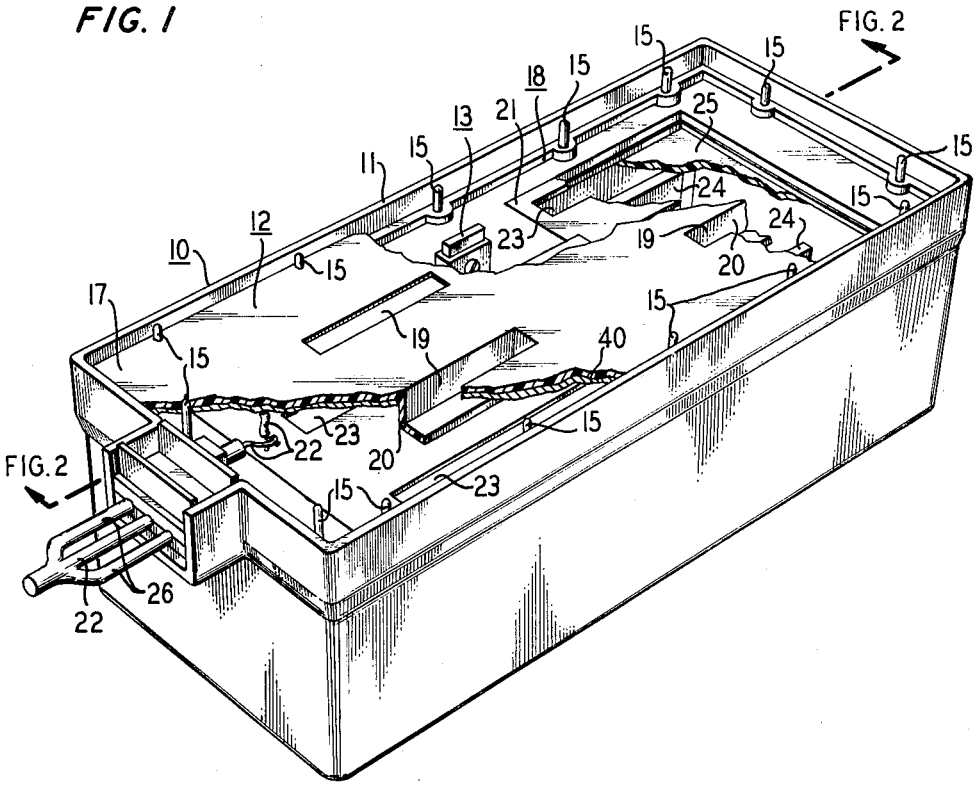
FIG. 1 is a perspective view of an embodiment of this invention with portions broken away to show interior components.
Figure 2:
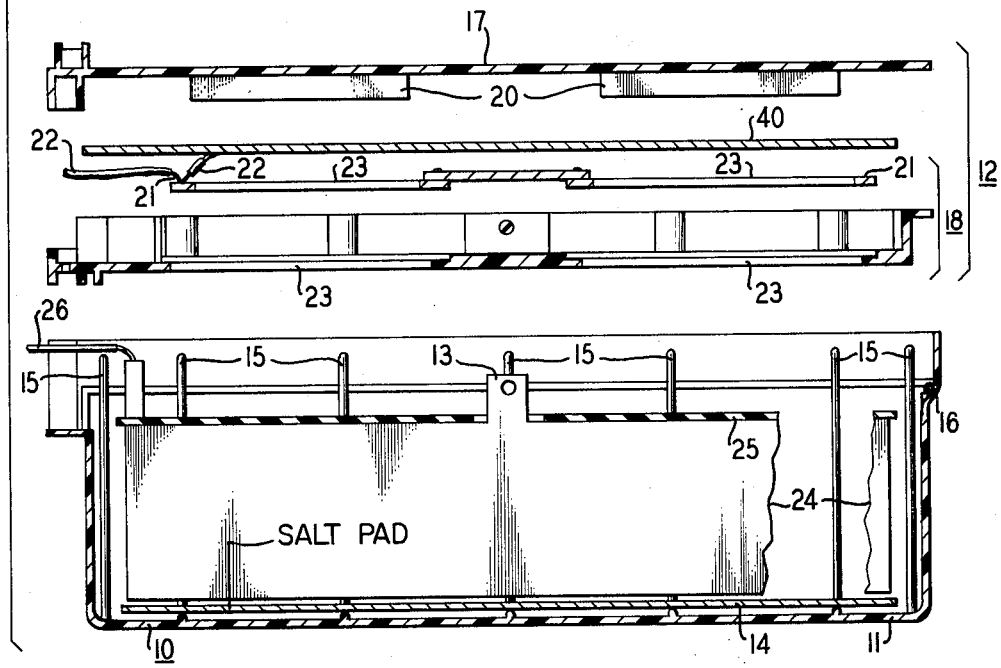
FIG. 2 is a side elevation view of the embodiment of the invention disclosed in FIG. 1 taken in section along the lines 2—2 with parts exploded to aid in visualization.

Referring to FIGS. 1 and 2, an evaporator device 10 is disclosed which comprises a container 11, a cover assembly 12, an electrode assembly 13 and a salt pad 14.

The container 11 may be made of any convenient nonelectrical conducting material such as glass, plastic or the like, and is adapted to receive and hold a condensate in its sealed bottom. As shown in FIGS. 1 and 2, the container 11 supports the cover assembly 12 at its open end. Advantageously, the container 11 is equipped with meltable mounting pegs 15 and, if desired, a gasket 16 to hold the cover assembly 12 tightly in place.

Referring to FIG. 2, the cover assembly 12 includes a cover plate 17 and a ground unit 18. The cover plate 17 may be advantageously made of a suitable plastic, it is perforated to accept the pegs 15 and, as best seen in FIG. 1, it has apertures 19 to permit condensate ingress and egress to and from the container 11, depending upon the physical state of the condensate. The cover plate 17 may also include diverters 20 when desired.

Similarly, the ground unit 18 must be made of an electrically non-conducting material such as plastic or the like and is equipped with one or more ground shields 21. As best seen in FIG. 2, each ground shield 21 is electrically linked to a ground lead 22 which may be grounded to the container 11 if desired. In addition, the ground shields 21 and the ground unit 18 are perforated with apertures 23. The ground shields 21 are made of an electrical conducting material which is preferably corrosion resistant such as stainless steel or the like. When assembled, the apertures 19 and 23 are disposed so that they are not coincident. Consequently condensate entering the apertures 19 must disperse to find the apertures 23 before it can run into the interior of the container 11. Where diverters 20 are used, they will further help in the dispersion.

Even if a gasket 16 is used, electrolyte leakage may occur around the edges of the cover plate 17 due to overfilling. As a result a possible electrical hazard could occur. Consequently, as best seen in FIG. 2, an auxiliary ground shield 40 can be interposed between the cover plate 17 and the ground unit 18. The auxiliary ground shield 40 may be advantageously made of stainless steel or other non-corroding, but electrically conducting, material.

By utilizing this arrangement, particularly with the diverters, safety is especially enhanced. Specifically, the ground shields 21 electrically shield users from the interior of the container 11 and the misalignment of the apertures 19 and 23, together with the diverters 20, mechanically prevent easy access to the interior of the container 11 as by a screwdriver or the like. Consequently, the design disclosed provides excellent safety characteristics without seriously hindering operations.

The electrode assembly 13, as best seen in FIGS. 1 and 2, mounts centrally within the container 11. Advantageously, it contains two stainless steel blades 24 and, if desired, an insulating spacer 25. If desired, the electrode assembly 13 can be joined to the cover assembly 12, as illustrated in FIG. 1, or it can be separately installed. In either case, the blades 24 are situated so that they will be immersed in the condensate as it fills the container 11. The blades 24 are connected electrically to an external power source (not shown) through the leads 26 and may be subjected to a continuous electrical potential.

As best seen in FIG. 2, the salt pad 14 is a thin rectangle and lies on the bottom of container 11 below the blades 24. The salt pad 14 may conveniently be made of a blotter-like material such as filter paper and is impregnated with a salt such as sodium bicarbonate or the like.

In operation, condensate trickles down through the apertures 19 and 23 in the cover plate 17 and ground plate 18 until it reaches the bottom of container 11 where it collects. As the condensate soaks the salt pad 14, salt is dissolved into the condensate and an electrolyte is formed. As condensate continues to be added, more electrolyte is formed until it contacts the blades 24. The blades 24 advantageously have an electrical potential at all times in the disclosed embodiment so, as the electrolyte contains their surfaces, current begins to flow and heats the electrolyte. As the heat builds up, the water portion of the electrolyte vaporizes and exits out of the cover assembly 12 until the level of electrolyte drops below the surfaces of the blades 24.

The system will continue to cycle as condensate is received from the external source. The advantage, however, is that no electrical timer or sensing devices are required. Consequently, the unit cannot overheat. Moreover, it is efficient in operation and safe to use.

If the evaporator device 10 is exposed to deep or over-filling, it will be advantageous to use the insulating spacer 25. Specifically, if the container 11 fills sufficiently, electric current may flow directly between the blades 24 and the ground shields 21. While that will not prevent operation, it will tend to quickly erode the ground shields 21. By using the insulating spacer 25, however, the conducting path through the electrolyte will be extended thereby reducing current flow and attendant erosion of the ground shields 21.

In summary, an improved condensate evaporator has been disclosed in which evaporation is achieved in a safe, efficient and trouble free manner. While only the most important embodiments have been disclosed, it will be recognized that they are merely illustrative of the principles of the invention and many other embodiments will readily occur to those skilled in the art which will fall within the scope of the invention.

What I claim is:

1. An improved evaporator device adapted to collect and disperse condensate comprising:

container means for collecting a condensate, said container means including a substantially rectangular base joining four substantially rectangular sides, each of said sides being joined end to end to form an open rectangular configuration and at one edge to said rectangular base to form an open substantially rectangular shaped receptacle, said sides being flared at the open end of said rectangular receptacle to form a shoulder;

electrode means for generating an electric current, said electrode means being mounted in said container means and including a pair of rectangular blades having geometric dimensions similar to those of one pair of facing sides in said container means, each of said blades including a projecting terminal at one end and a centrally located projecting mounting ear for cooperating with a support portion, grounding means for interposing a protective ground plane between said electrode means and the open end of said container means, said grounding means being mounted in the open end of said container means and including an electrically inert support portion adapted to accept said ear and at least one substantially rectangular metallic plate, said plate being perforated by a pluarlity of parallel slots so that condensate can flow therethrough and into said container means;

conductor means for delivering electricity to said electrodes and including line leads connected to said terminals on said blades and a ground lead connected to said plate;

cover means for enclosing the open end of said container means, said cover means being mounted on said shoulder in said container means and including a plurality of diverters and a plurality of slots disposed in relation to the slots in said grounding means to form pairs adapted to cooperatively pass condensate therethrough and into said container means, and a salt composition dispersed in said container whereby condensate collected in said container means will mix with said salt composition so as to improve electrical conductivity between said blades when said condensate reaches the level permitting contact with said blades.

2. An improved evaporator device adapted to collect and disperse condensate in accordance with claim 1 wherein said container means includes a plurality of aligning pins projecting above the shoulder formed by said sides and said cover means includes a plurality of aligning perforations adapted to accept said pins when said cover means is mounted on said container means.

3. An improved evaporator device adapted to collect and disperse condensate in accordance with claim 2 including gasket means interposed between said cover means and said container means.

4. An improved evaporator device adapted to collect and disperse condensate in accordance with claim 1 wherein each diverter is located between the slots of each pair of cooperating slots, each slot of the pair being offset from the other to prevent mechanical access to the interior of said container means and said diverter directs condensate flow from one slot to the other as it passes into said container means.

5. An improved evaporator device adapted to collect and disperse condensate in accordance with claim 1 wherein said salt composition is contained in a salt pad disposed in said container in spaced relationship from said blades.

* * * * *